US011028848B2

(12) United States Patent
Okamoto et al.

(10) Patent No.: US 11,028,848 B2
(45) Date of Patent: Jun. 8, 2021

(54) SCROLL COMPRESSOR HAVING A FITTED BUSHING AND WEIGHT ARRANGEMENT

(71) Applicant: Mitsubishi Electric Corporation, Tokyo (JP)

(72) Inventors: Masaya Okamoto, Tokyo (JP); Tomokazu Matsui, Tokyo (JP); Syuhei Koyama, Tokyo (JP); Yuji Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 120 days.

(21) Appl. No.: 16/071,102

(22) PCT Filed: Mar. 30, 2016

(86) PCT No.: PCT/JP2016/060380
§ 371 (c)(1),
(2) Date: Jul. 19, 2018

(87) PCT Pub. No.: WO2017/168631
PCT Pub. Date: Oct. 5, 2017

(65) Prior Publication Data

US 2019/0264687 A1 Aug. 29, 2019

(51) Int. Cl.
*F04C 18/02* (2006.01)
*F04C 23/00* (2006.01)

(52) U.S. Cl.
CPC ..... *F04C 18/0215* (2013.01); *F04C 23/008* (2013.01); *F04C 2210/22* (2013.01); *F04C 2210/263* (2013.01); *F04C 2240/807* (2013.01)

(58) Field of Classification Search
CPC ..... F04C 18/0215; F04C 2210/22; F04C 2240/807; F04C 23/008; F04C 2210/263
(Continued)

(56) References Cited

U.S. PATENT DOCUMENTS

2012/0188844 A1* 7/2012 Tiltman ..... B29C 39/003 367/2
2012/0244026 A1* 9/2012 Hahn ..... F04C 18/0215 418/55.1
(Continued)

FOREIGN PATENT DOCUMENTS

DE 29620340 U1 * 3/1997 ..... A47G 7/047
EP 2 913 531 A1 9/2015
(Continued)

OTHER PUBLICATIONS

Derwent English Abstract of JP2003343454A (Year: 2003).*
(Continued)

*Primary Examiner* — Mary Davis
*Assistant Examiner* — Paul W Thiede
(74) *Attorney, Agent, or Firm* — Posz Law Group, PLC

(57) ABSTRACT

A scroll compressor includes: a compression mechanism unit 3 that includes a fixed scroll 31 and an orbiting scroll 32; a crank shaft 6 that causes the orbiting scroll 32 to orbit about the fixed scroll 31; a slider 71 that is provided between the orbiting scroll 32 and the crank shaft 6 and that includes tubular portions 711 and 712 and a flange portion 713 projecting from the outer circumferential surface between one end and the other end of the tubular portions 711 and 712; and a balance weight 72 that is fitted to the slider 71 and that includes a ring-like portion 721 having a portion of the inner surface facing the flange portion 713, a weight portion 722 having an inner surface facing the tubular portion 711 or 712 closer to the one end side U than the flange portion 713, and a projection 723 projecting from the inner circumferential surface of the ring-like portion 721 and having an inner surface facing the tubular portion 711 or 712 closer to the other end side L than the flange portion 713.

10 Claims, 4 Drawing Sheets

(58) Field of Classification Search
USPC ..... 418/55.1, 55.2, 55.3, 55.4, 55.5, 55.6
See application file for complete search history.

(56) References Cited

U.S. PATENT DOCUMENTS

| | | | | |
|---|---|---|---|---|
| 2015/0204599 | A1* | 7/2015 | Chisaki | F24F 1/56 62/426 |
| 2017/0082109 | A1* | 3/2017 | Kawamura | F04C 29/0057 |

FOREIGN PATENT DOCUMENTS

| | | | | |
|---|---|---|---|---|
| JP | 2003343454 | A * | 12/2003 | |
| JP | 3858762 | B2 | 12/2006 | |
| JP | 2015-165105 | A | 9/2015 | |
| WO | WO-2015190195 | A1 * | 12/2015 | F04C 29/0057 |

OTHER PUBLICATIONS

English Machine Translation of JP2003343454A. Translated on Nov. 24, 2020. (Year: 2003).*
International Search Report dated Jun. 28, 2016 issued in corresponding international patent application No. PCT/JP2016/06038.

* cited by examiner

SCROLL COMPRESSOR HAVING A FITTED BUSHING AND WEIGHT ARRANGEMENT

CROSS REFERENCE TO RELATED APPLICATION

This application is a U.S. national stage application of PCT/JP2016/060380 filed on Mar. 30, 2016, the contents of which are incorporated herein by reference.

TECHNICAL FIELD

The present invention relates to a scroll compressor having a slider.

BACKGROUND ART

In a conventional scroll compressor, a fixed scroll having a spiral vane and an orbiting scroll having a spiral vane are combined to form a plurality of compression chambers, and refrigerant or other medium is compressed by the rotation of the orbiting scroll. To reduce the scroll pressing load caused by the spiral vane during the rotation of the orbiting scroll, some scroll compressors of this type are configured to have a bushing, in which a slider and a balance weight to offset or cancel the centrifugal force generated by the orbiting scroll are joined together, at the upper end portion of a crank shaft (for example, see Patent Literature 1).

Furthermore, there is a bushing in which a slider has a flange portion on the outer circumference of the lower end portion thereof, a balance weight has a holding portion on the inner circumference thereof, and the slider and the balance weight are positioned relative to each other at the contact surfaces of the flange portion and the holding portion and are fixed together by shrink fitting (for example, see Patent Literature 2).

CITATION LIST

Patent Literature

Patent Literature 1: Japanese Unexamined Patent Application Publication No. 2015-165105

Patent Literature 2: Japanese Patent No. 3858762

SUMMARY OF INVENTION

Technical Problem

In Patent Literature 1, because the outer circumferential surface of the slider has a straight structure, when the balance weight is fixed at a predetermined position on the outer circumferential surface of the slider by shrink fitting, the balance weight has to be positioned in the axial direction by using a jig or other tool.

In Patent Literature 2, although there is no need to position the balance weight in the axial direction by using a jig or other tool because the slider has the flange portion on the outer circumferential surface of the lower end thereof, since the slider is inserted into the center hole in the balance weight when shrink fitting is performed, the positioning process is not easy.

The present invention has been made to overcome the above-described problems, and an object thereof is to provide a scroll compressor and a refrigeration cycle device in which the positioning between a slider and a balance weight is easy.

Solution to Problem

A scroll compressor according to an embodiment of the present invention includes: a compression mechanism unit that includes a fixed scroll and an orbiting scroll; a crank shaft that causes the orbiting scroll to orbit about the fixed scroll; a slider that is provided between the orbiting scroll and the crank shaft and that includes a tubular portion and a flange portion projecting from an outer circumferential surface between one end and an other end of the tubular portion; and a balance weight that is fitted to the slider and that includes a ring-like portion having a portion of an inner surface facing the flange portion, a weight portion having an inner surface facing the tubular portion closer to the one end than the flange portion, and a projection projecting from an inner circumferential surface of the ring-like portion and having an inner surface facing the tubular portion closer to the other end than the flange portion.

Advantageous Effects of Invention

According to the present invention, it is possible to provide a scroll compressor and a refrigeration cycle device in which the positioning between a slider and a balance weight is easy.

DESCRIPTION OF EMBODIMENTS

An embodiment of the present invention will be described below with reference to the drawings. Note that, in the figures, the same or equivalent portions are denoted by the same reference signs, and the descriptions thereof will be omitted or simplified where appropriate. Furthermore, the shapes, sizes, arrangements, and other properties of the configurations shown in the figures may be appropriately modified within the scope of the present invention.

Embodiment 1

Figure 1:
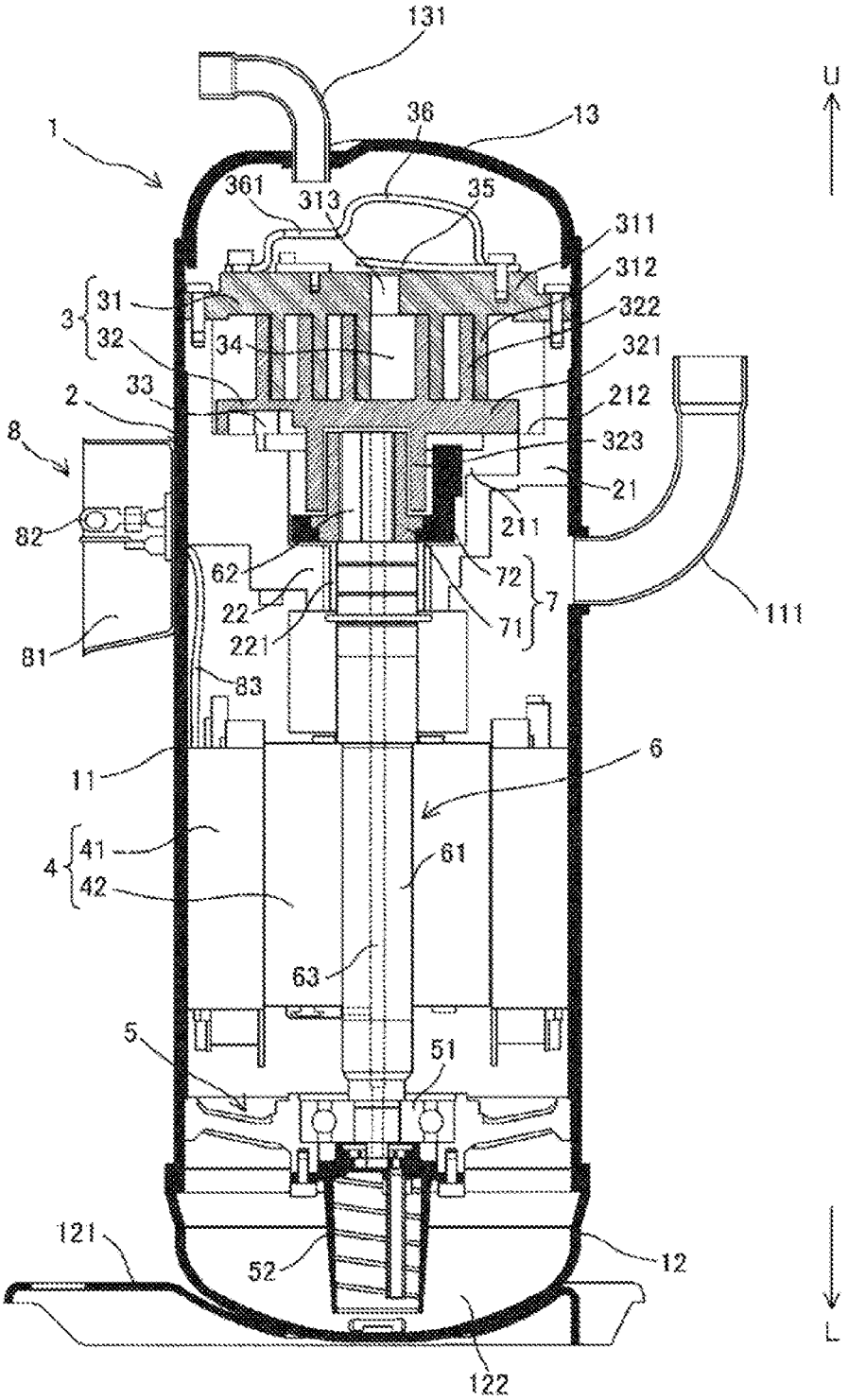
FIG. 1 is a schematic vertical sectional view of a scroll compressor according to Embodiment 1 of the present invention.

Embodiment 1 will be described below. FIG. 1 is a schematic vertical sectional view of a scroll compressor according to Embodiment 1. Note that the compressor in FIG. 1 is what is called a vertical scroll compressor that is used in a state in which the central axis of a crank shaft (described below) is substantially perpendicular to the ground. In the descriptions below, to refer to positions in the vertical direction in, for example, FIG. 1 showing the scroll compressor, the terminologies, one end side U and the other end side L, may be used. Where any referent is said to be on the one end side U relative to a subject being compared, that may mean the referent is located upper in the vertical direction than the compared subject. Similarly, where any referent is said to be on the other end side L relative to a subject being compared, that may mean the referent is located lower in the vertical direction than the compared subject. The other end side is, in other words, the ground side. The referent and the compared subject may be within the extremities of an element as a whole.

The scroll compressor includes a shell 1, a main frame 2, a compression mechanism unit 3, a driving mechanism unit 4, a sub frame 5, a crank shaft 6, a bushing 7, and a power supply unit 8.

The shell 1 is a tubular housing that is a part made of a conducting material, such as metal, and has closed ends. The shell 1 includes a middle shell 11, a lower shell 12, and an upper shell 13. The middle shell 11 is cylindrical and has a suction pipe 111 in a side wall thereof. The suction pipe 111 is a pipe through which refrigerant is introduced into the shell 1 and communicates with the inner space of the middle shell 11. The lower shell 12 is a substantially hemispherical bottom body, and a portion of the side wall thereof is joined to the lower end portion of the middle shell 11 by welding or other method to close the opening of the middle shell 11 at the bottom. The upper shell 13 is a substantially hemispherical lid body, and a portion of the side wall thereof is joined to the upper end portion of the middle shell 11 by welding or other method to close the opening of the middle shell 11 at the top. The upper shell 13 has a discharge pipe 131 at the top. The discharge pipe 131 is a pipe through which the refrigerant is discharged to the outside of the shell 1. The discharge pipe 131 communicates with the inner space of the middle shell 11. Note that the shell 1 is supported by a fixing base 121 having a plurality of screw holes, and, by screwing screws into the screw holes, the scroll compressor can be fixed to another part, such as a housing of an outdoor unit.

The main frame 2 is a metal support part and is disposed inside the shell 1. The main frame 2 includes a body unit 21 and a main bearing unit 22. The body unit 21 is securely fixed to and supported by the inner circumferential surface of the upper part of the middle shell 11 by shrink fitting, welding, or other method and has, inside thereof, an accommodating space 211 extending in the longitudinal direction of the shell 1. The accommodating space 211 is open on the one end side U thereof and has steps inside such that the space narrows toward the other end side L. A thrust surface 212 is formed on a portion of the step portions. The main bearing unit 22 is formed to be continuous with the other end side L of the body unit 21 and has a through-hole 221 inside thereof. The through-hole 221 penetrates in the top-bottom direction of the main bearing unit 22, and the one end side U thereof communicates with the accommodating space 211.

The compression mechanism unit 3 is a compression mechanism that compresses refrigerant. In Embodiment 1, the compression mechanism unit 3 is a scroll compression mechanism that includes a fixed scroll 31 and an orbiting scroll 32. The fixed scroll 31 includes a first substrate 311 and a first spiral body 312. The first substrate 311 has a disc shape, and the outer end portion of the first substrate 311 is in contact with the surface of the body unit 21 on the one end side U of the body unit 21 and is fixed to the main frame 2 with screws or other fasteners. The first spiral body 312 projects from the surface of the first substrate 311 on the other end side L and forms a spiral vane, and the distal end thereof is oriented toward the other end side L. The orbiting scroll 32 includes a second substrate 321, a second spiral body 322, and a tubular portion 323. The second substrate 321 has a disc shape and is disposed in the accommodating space 211 such that the outer circumferential surface thereof on the other end side L slides on the thrust surface 212 of the main frame 2. The second spiral body 322 projects from the surface on the one end side U of the second substrate 321 and forms a spiral vane, and the distal end thereof is oriented toward the one end side U. The tubular portion 323 is a cylindrical boss that is projecting from substantially the center of the surface of the second substrate 321 on the other end side L. Furthermore, an Oldham ring 33 is provided between the main frame 2 and the second substrate 321 of the orbiting scroll 32. The Oldham ring 33 has a pair of projections on each side of the ring, and the projections are accommodated in corresponding grooves formed in the main frame 2 and grooves formed in the second substrate 321. With this configuration, the Oldham ring 33 prevents the rotation of the orbiting scroll 32 when the orbiting scroll 32 revolves due to the rotation of the crank shaft 6.

By meshing the first spiral body 312 of the fixed scroll 31 and the second spiral body 322 of the orbiting scroll 32 together, a compression space 34 is formed. The compression space 34 is a space of a volume narrowing from the outside toward the inside in the radial direction. As a result of the refrigerant being taken in from the outside and the orbiting scroll 32 revolving, the refrigerant is compressed. The compression space 34 communicates with a discharge port 313, which is formed at the central portion of the first substrate 311 of the fixed scroll 31 to penetrate in the top-bottom direction, and the compressed refrigerant is discharged from the discharge port 313. A discharge valve 35 that opens and closes the discharge port 313 in a predetermined manner and prevents backflow of the refrigerant, and a muffler 36 that has a discharge hole 361 and covers the discharge port 313 and the discharge valve 35 are fixed to the surface on the one end side U of the fixed scroll 31 with screws or other fasteners.

The refrigerant includes, for example, halogenated hydrocarbons having a carbon-carbon double bond in the composition, halogenated hydrocarbons having no carbon-carbon double bond in the composition, hydrocarbons, and mixtures containing them. The halogenated hydrocarbons having a carbon-carbon double bond include HFO refrigerant and fluorocarbon-based low-GWP refrigerant, whose ozone depletion potentials are zero, and the examples include tetrafluoropropenes, such as HFO1234yf, HFO1234ze, and HFO1243zf, which have the chemical formula C3H2F4. The tetrafluoropropenes have a double bond in their chemical formulae, are easy to be decomposed in the air, have low (4 to 6) global warming potentials (GWP) and thus are environment-friendly, but have lower densities than existing refrigerants, such as R410A. Examples of the halogenated hydrocarbons having no carbon-carbon double bond include refrigerants in which R32 (difluoromethane), R41, or other component having the chemical formula CH2F2 is mixed. Examples of the hydrocarbons include propane, propylene, or other component, which are natural refrigerants. Examples of the mixtures include mixed refrigerants in which R32, R41, or other component is mixed in HFO1234yf, HFO1234ze, HFO1243zf, or other component.

The driving mechanism unit 4 is provided on the other end side L of the main frame 2 inside the shell 1. The driving mechanism unit 4 includes a stator 41 and a rotor 42. The stator 41 is a stationary part that has an annular shape formed by, for example, winding a winding wire around an iron core, which is formed by stacking a plurality of electromagnetic steel plates, with an insulating layer therebetween. The outer circumferential surface of the stator 41 is securely fixed to and supported by the inside of the middle shell 11 by shrink fitting or other method. The rotor 42 is a cylindrical rotating part that has a permanent magnet inside an iron core, which is formed by stacking a plurality of electromagnetic steel plates, and has a through-hole penetrating in the top-bottom direction at the center thereof. The rotor 42 is disposed in the inner space of the stator 41.

The sub frame 5 is a support part made of metal and is provided on the other end side L of the driving mechanism unit 4 inside of the shell 1. The sub frame 5 is securely fixed to and supported by the inner circumferential surface of the lower part of the middle shell 11 by shrink fitting, welding, or other method. The sub frame 5 includes an auxiliary bearing unit 51 and an oil pump 52. The auxiliary bearing unit 51 is a ball bearing provided on the upper side of the central portion of the sub frame 5 and has a through-hole penetrating in the top-bottom direction at the center. The oil pump 52 is provided on the lower side of the central portion of the sub frame 5 and is disposed such that at least a portion thereof is immersed in lubricant (not shown) accommodated in a lubricant reservoir 122 formed inside the lower shell 12 of the shell 1.

The crank shaft 6 is a long, bar-like metal part provided inside the shell 1. The crank shaft 6 includes a main shaft unit 61 and an eccentric shaft unit 62 and has a lubricant passage hole 63. The outer surface of the main shaft unit 61 is in contact with and fixed to the through-hole in the rotor 42. The main shaft unit 61 is disposed such that the portion corresponding to the rotor 42 is positioned in the inner space of the stator 41 and such that the central axis thereof is aligned with the central axis of the middle shell 11. The eccentric shaft unit 62 is provided at the one end side U relative to the main shaft unit 61 such that the central axis thereof is eccentric relative to the central axis of the main shaft unit 61. The lubricant passage hole 63 is provided inside the main shaft unit 61 and the eccentric shaft unit 62 to penetrate in the top-bottom direction. A portion on the one end side U of the crank shaft 6, which is the eccentric shaft unit 62, is inserted into and fixed to the tubular portion 323, and the crank shaft 6 is inserted into and fixed to the auxiliary bearing unit 51 of the sub frame 5 at the other end side L. With this configuration, the crank shaft 6 is positioned inside the main bearing unit 22 of the main frame 2, and a predetermined space is maintained between the outer surface of the rotor 42 and the inner surface of the stator 41.

The bushing 7 is a doughnut-shaped mechanical part and is fixed to the eccentric shaft unit 62 of the crank shaft 6. The bushing 7 includes a slider 71 and a balance weight 72. The slider 71 is a tubular metal part that is made of, for example, iron and is inserted into each of the eccentric shaft unit 62 and the tubular portion 323 to connect the orbiting scroll 32 and the crank shaft 6. The balance weight 72 is a doughnut-shaped metal part that is made of, for example, iron and is fitted into the slider 71.

The power supply unit 8 is a power supply part that supplies power to the scroll compressor and is formed on the outer circumferential surface of the middle shell 11 of the shell 1. The power supply unit 8 includes a cover 81, a power supply terminal 82, and a wire 83. The cover 81 is a cover part that has a bottom and an opening. The power supply terminal 82 is a metal part having one end provided inside the cover 81 and the other end provided inside the shell 1. The wire 83 has one end connected to the power supply terminal 82 and the other end connected to the stator 41.

Figure 2:
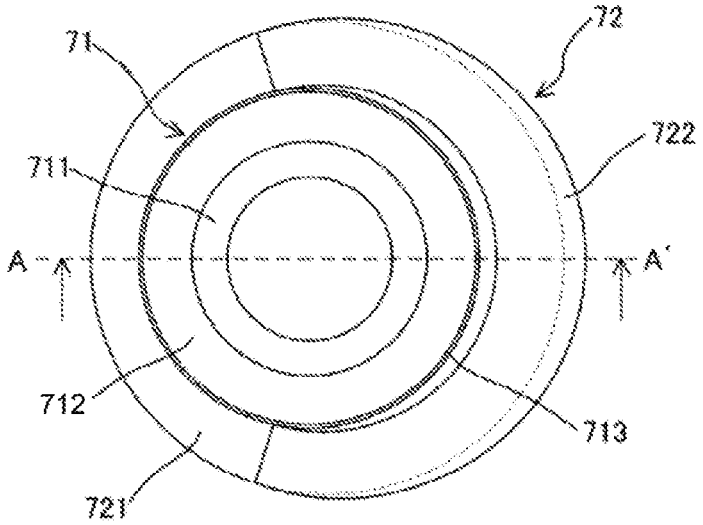
FIG. 2 shows a bushing of the scroll compressor according to Embodiment 1 of the present invention, as viewed from one end.
Figure 3:
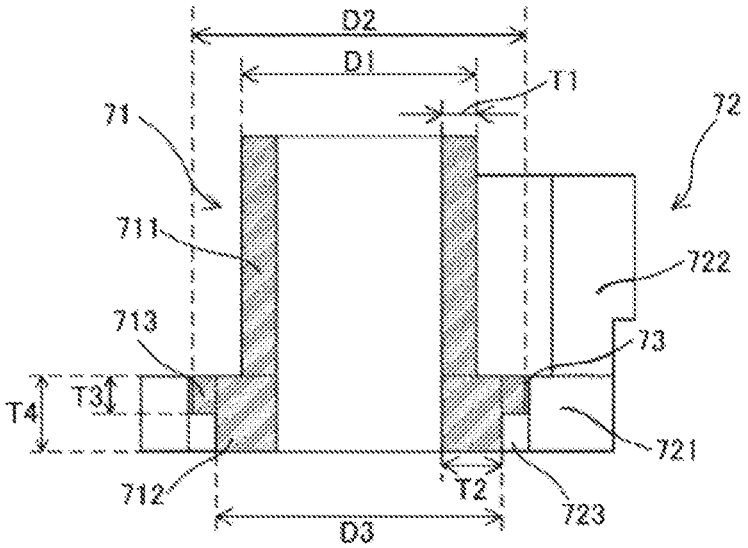
FIG. 3 is a sectional view of the bushing of the scroll compressor according to Embodiment 1 of the present invention, taken along line A-A' in FIG. 2, as viewed in the direction indicated by the arrows.

The bushing 7 will be described in detail with reference to FIGS. 2 and 3. FIG. 2 shows the bushing of the scroll compressor according to Embodiment 1 of the present invention, as viewed from one end. FIG. 3 is a sectional view of the bushing of the scroll compressor according to Embodiment 1 of the present invention, taken along line A-A' in FIG. 2, as viewed in the direction indicated by the arrows.

The bushing 7 is formed of the slider 71 and the balance weight 72 disposed on the outer circumference thereof. The slider 71 includes a tubular portion, which includes a first tubular portion 711 and a second tubular portion 712, and a flange portion 713. The first tubular portion 711 is a cylinder positioned on the one end side U of the slider 71, and the second tubular portion 712 is a cylinder provided on the other end side L of the first tubular portion 711 to be continuous with the first tubular portion 711. The thickness T2 of the second tubular portion is larger than the thickness T1 of the first tubular portion 711. Furthermore, because the inside diameters of the first tubular portion 711 and the second tubular portion 712 are the same as each other, the outside diameter D3 of the second tubular portion 712 is larger than the outside diameter D1 of the first tubular portion 711. The flange portion 713 is a flange formed on the outer surface on the one end side U of the second tubular portion 712. In other words, the flange portion 713 is projecting from the outer circumferential surface between one end and the other end of the tubular portions 711 and 712. The outside diameter D2 of the flange portion 713 is larger than the outside diameter D3 of the second tubular portion 712. Furthermore, the relationship between the thickness T3 of the flange portion 713 and the thickness T4 of the second tubular portion 712 is $T3 \leq T4/2$.

The balance weight 72 includes a ring-like portion 721, a weight portion 722, and a projection 723. The ring-like portion 721 is a ring part positioned on the other end side L of the balance weight 72, and a portion of the inner surface of the ring-like portion 721 faces the flange portion 713. The weight portion 722 is formed on at least a portion of the ring-like portion 721 to project upwardly toward the second substrate 321 of the orbiting scroll 32 and is disposed such that the inner surface thereof faces the first tubular portion 711, which is a part of the tubular portion on the one end side U relative to the flange portion 713. The weight portion 722 is provided in a space formed by the main frame 2, the second substrate 321, and the tubular portion 323. The projection 723 is formed on the inner surface of the ring-like portion 721 on the other end side L to project toward the center and is disposed such that the inner surface thereof faces the second tubular portion 712, which is another part of the tubular portion on the other end side L relative to the flange portion 713. In other words, the projection 723 forms a step in the inside of the ring-like portion 721 of the projection 723. The meaning of the word "face" includes, besides a state in which two objects face each other with a space therebetween, a state in which they are in contact with each other without a space therebetween, a state in which they are in contact with each other without a space therebetween.

In the slider 71 and the balance weight 72, the outer surface of the second tubular portion 712 and the inner surface of the projection 723 are fitted together by shrink fitting with the surface, on the other end side L, of the flange portion 713, and the surface, on the one end side U, of the projection 723 being in contact with each other. Furthermore, a gap 73 is provided between the outer surface of the flange portion 713 and the inner surface, on the one end side U, of the ring-like portion 721.

How to fit the slider 71 and the balance weight 72 together will be described. First, the balance weight 72 is expanded by heating, and then, the second tubular portion 712 and the flange portion 713 of the slider 71 are inserted into the inner space of the ring-like portion 721 from the one end side U of the balance weight 72. At this time, the surface, on the other end side L, of the flange portion 713 and the surface, on the one end side U of the projection 723 are brought into contact with each other to position the slider 71 and the balance weight 72. Then, the balance weight 72 is contracted by cooling to fit (shrink-fit) the outer surface of the second tubular portion 712 and the inner surface of the projection 723 together. Once the shrink fitting is done, there is no problem if the surface, on the other end side L, of the flange portion 713 and the surface, on the one end side U, of the projection 723, which have been in contact with each other, are separated by a small gap. Note that, in Embodiment 1, the gap 73 is provided between the flange portion 713 and the one end side U of the ring-like portion 721, so, the flange portion 713 and the ring-like portion 721 are not fitted together. The gap 73 can be used when the surface, on the other surface side, of the flange portion 713 of the slider 71 and the surface, on the one end side U, of the ring-like portion 721 of the balance weight 72 are brought into contact with each other or when the second tubular portion 712 and the projection 723 are fitted together in the shrink-fitting process.

As has been described, in the process of shrink-fitting the slider 71 and the balance weight 72 together, only the second tubular portion 712 and the flange portion 713 of the slider 71 are inserted into the inner space of the balance weight 72, and the first tubular portion 711 does not pass through the inner space of the balance weight 72. When, as disclosed in Patent Literature 2, the tubular portion of the slider is also inserted into the hole in the balance weight, the outer circumferential surface of the tubular portion could be damaged during the process. Because the outer circumferential surface of the slider is required to be precise, such damage could significantly lower the reliability and decreases the shrink-fitting yield and the working efficiency. In Embodiment 1, because the outer surface of the first tubular portion 711 is not damaged, it is possible to improve the reliability, as well as improving the shrink-fitting yield and the working efficiency. Furthermore, because the positioning can be done by bringing the surface, on the other end side L, of the flange portion 713 and the surface, on the one end side U, of the projection 723 into contact with each other; it is possible to improve the working efficiency during the shrink fitting. Specifically, because the slider 71 and the balance weight 72 can be easily positioned, the fitting process is simplified.

Furthermore, during shrink fitting, the slider 71 is subjected to a stress that tends to deform and contract the one end side U of a portion to be shrink-fitted radially inward. Hence, the slider as disclosed in Patent Literature 1 tends to be deformed by shrink fitting. In particular, because the centrifugal force of the balance weight increases with an increase in the amount of force cancelled by the balance weight, the shrink-fitting force needs to be increased, which will increase deformation of the slider caused by shrink fitting. In contrast, in Embodiment 1, the thickness of the one end side U of the portion to be shrink-fitted, that is, the boundary between the second tubular portion 712 and the other end side L of the flange portion 713, is larger than the thickness of the first tubular portion 711. Hence, it is possible to minimize deformation of the slider 71. Note that, it is more preferable that the slider 71 to be used be subjected to quenching or tempering for increased rigidity and be subjected to surface treatment, such as nitriding, manganese phosphate treatment, or diamond-like carbon (DLC) treatment, for increased sliding property. Doing so makes the fitting process easy. Furthermore, because the second tubular portion 712 of the slider 71 has a larger thickness and thus has higher rigidity than the first tubular portion 711, the amount of deformation can be reduced even if it is subjected to a load during shrink fitting.

The operation of the scroll compressor will be described. When power is supplied to the power supply terminal 82 of the power supply unit 8, torques are generated in the stator 41 and the rotor 42, rotating the crank shaft 6. The rotation of the crank shaft 6 is transmitted to the orbiting scroll 32 via the bushing 7, and the orbiting scroll 32 eccentrically revolves, while being inhibited from rotating by the Oldham ring 33, with the surface of the second substrate 321 on the other end side L sliding on the thrust surface 212. At this time, the lubricant accumulated in the lubricant reservoir 122 is sucked by the oil pump 52, is distributed, via the lubricant passage hole 63 in the crank shaft 6, to driving portions that need to be lubricated, such as the interface between the main bearing unit 22 and the main shaft unit 61, the interface between the thrust surface 212 and the second substrate 321, and the interface between the fixed scroll 31 and the orbiting scroll 32, and then returns to the lubricant reservoir 122 through a lubricant discharge hole (not shown) provided in the main frame 2.

Meanwhile, the refrigerant taken into the shell 1 from the suction pipe 111 passes through the refrigerant path provided in the main frame 2 and is taken into the compression space 34. Then, the refrigerant is reduced in volume and is compressed as it moves from the outer circumferential portion toward the center in accordance with the eccentric revolution of the orbiting scroll 32. During the eccentric revolution of the orbiting scroll 32, the orbiting scroll 32 moves in the radial direction together with the bushing 7 due to the centrifugal force of its own, bringing the second spiral body 322 and the first spiral body 312 into tight contact with each other. Thus, leakage of the refrigerant from the high-pressure side to the low-pressure side in the compression space 34 is prevented, and efficient compression is performed. The compressed refrigerant is discharged from the discharge port 313 in the fixed scroll 31 against the discharge valve 35 and is discharged to the outside of the shell 1 through the discharge hole 361 in the muffler 36 and the discharge pipe 131.

The weight portion 722 provided in the balance weight 72 of the bushing 7 cancels out the centrifugal force caused by the orbiting movement of the orbiting scroll 32. Meanwhile, when the crank shaft 6 rotates, the balance weight 72 is subjected to centrifugal force and thus is subjected to a clockwise moment that tilts the balance weight 72 outward. However, because the moment is brought into contact at the surface, on the other end side L, of the flange portion 713 of the slider 71 and the surface, on the one end side U, of the projection 723 of the balance weight 72, it is possible to receive the moment with the contact surfaces, and thus, to minimize deformation of the slider 71 caused by separation of the slider 71 and the balance weight 72 and by the moment. Although it is difficult to increase the thickness T4 of the second tubular portion 712 due to the limited space in which the bushing 7 is disposed, the thickness T3 of the flange portion 713 with the thickness T4 of the second tubular portion 712 may be changed according to the purpose. For example, in a specification in which the moment applied to the balance weight 72 is small, the dimension of the shrink-fitted portion may be increased for higher fitting strength by setting the thickness T3 of the flange portion 713 to be smaller than half the thickness T4 of the second tubular portion 712.

Furthermore, when a refrigeration cycle device having a compressor, a condenser, an expansion valve, and an evaporator performs compression similar to conventional compression using a refrigerant, such as HFO1234yf, having a lower density than existing refrigerants, such as R410A, the speed of the eccentric revolution of the orbiting scroll 32 needs to be increased, which increases the centrifugal force applied to the balance weight 72. However, as described above, because the influence of the moment caused by the centrifugal force can be canceled out by the flange portion 713 and the projection 723, highly reliable operation is possible even with a refrigerant such as HFO1234yf.

In Embodiment 1, the scroll compressor includes: the compression mechanism unit 3 that includes the fixed scroll 31 and the orbiting scroll 32; the crank shaft 6 that causes the orbiting scroll 32 to orbit about the fixed scroll 31; the slider 71 that is provided between the orbiting scroll 32 and the crank shaft 6 and that has the tubular portions 711 and 712 and the flange portion 713 projecting from the outer circumferential surface between one end and the other end of the tubular portions 711 and 712; and the balance weight 72 that is fitted to the slider 71 and that includes the ring-like portion 721 having a portion of the inner surface facing the flange portion 713, the weight portion 722 having an inner surface facing the tubular portion 711 or 712 closer to the one end side U than the flange portion 713, and the projection 723 projecting from the inner circumferential surface of the ring-like portion 721 and having the inner surface facing the tubular portion 711 or 712 closer to the other end side L than the flange portion 713. Accordingly, in the process of shrink-fitting the slider 71 and the balance weight 72 together, the flange portion 713 and the projection 723 can be brought into contact with each other, and thus, positioning is easy. Furthermore, it is possible to minimize deformation of the slider 71 when the moment is applied to the balance weight 72. Furthermore, the outer surface of the tubular portions 711 and 712 will not be damaged, improving the reliability.

Furthermore, the outer surface of the second tubular portion 712, which is the tubular portion closer to the other end side L than the flange portion 713, and the inner surface of the projection 723 are fitted together, and the gap 73 is provided between the outer surface of the flange portion 713 and a portion of the inner surface of the ring-like portion 721. Accordingly, highly reliable positioning and fitting are possible.

Furthermore, the tubular portion of the slider 71 includes the first tubular portion 711 and the second tubular portion 712 on one side of the first tubular portion 711, the flange portion 713 is provided on the second tubular portion 712, at a portion close to the first tubular portion 711, the thickness T2 of the second tubular portion 712 is larger than the thickness T1 of the first tubular portion 711, and the outside diameter D2 of the second tubular portion 712 is larger than the outside diameter D1 of the first tubular portion 711. Accordingly, it is possible to improve the rigidity of the second tubular portion 712, which is to be fitted by shrink fitting, and hence, to minimize deformation.

Furthermore, refrigerant including HFO1234yf is supplied to the compression mechanism unit 3. Although the speed of the eccentric revolution of the orbiting scroll 32 needs to be increased when compression similar to conventional compression is to be performed with low-density refrigerant, such as HFO1234yf, it is possible to perform highly reliable operation even at a high speed.

Embodiment 2

Figure 4:
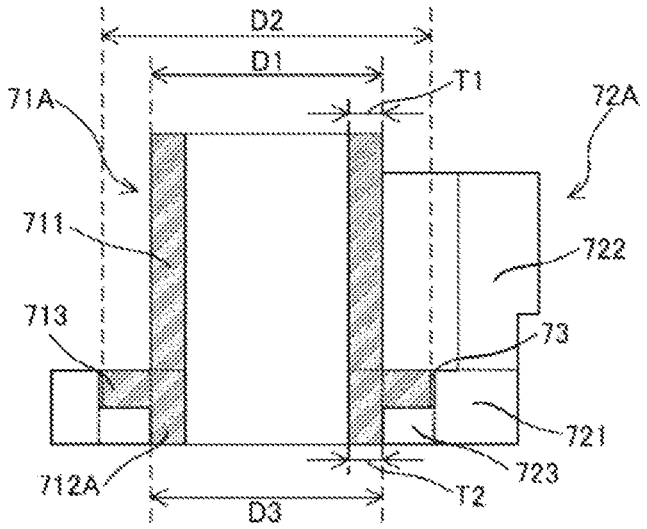
FIG. 4 is a sectional view showing the structure of a bushing of a scroll compressor according to Embodiment 2 of the present invention.

FIG. 4 is a sectional view showing the structure of a bushing of a scroll compressor according to Embodiment 2 of the present invention. In FIG. 4, portions having the same configurations as those of the compressor in FIGS. 1 to 3 are denoted by the same reference signs, and the descriptions thereof will be omitted.

As shown in FIG. 4, in Embodiment 2, the thickness T2 (the outside diameter D3) of a second tubular portion 712A of a slider 71A is equal to the thickness T1 (the outside diameter D1) of the first tubular portion 711. The structure of a balance weight 72A is the same as that in Embodiment 1. Embodiment 2 provides the same advantages as those in Embodiment 1 and makes the production of the slider 71A easier than that in Embodiment 1.

Embodiment 3

Figure 5:
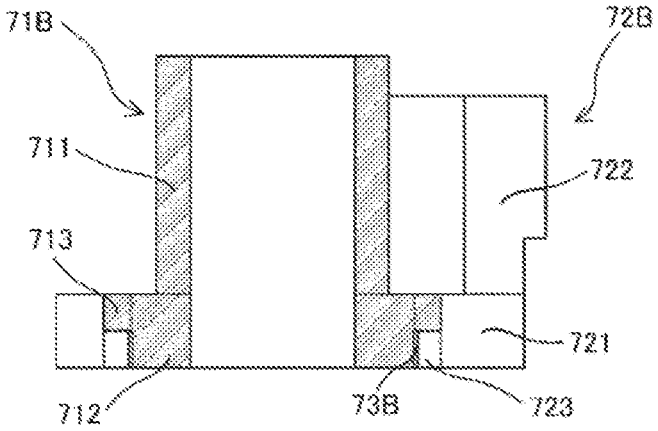
FIG. 5 is a sectional view showing the structure of a bushing of a scroll compressor according to Embodiment 3 of the present invention.

FIG. 5 is a sectional view showing the structure of a bushing of a scroll compressor according to Embodiment 3 of the present invention.

As shown in FIG. 5, in Embodiment 3, the outer circumferential surface of the flange portion 713 of a slider 71B and the one end side U of the ring-like portion 721 of a balance weight 72B are fitted together, and a space 73B is provided between the outer circumferential surface of the second tubular portion 712 and the inner circumferential surface of the projection 723. In Embodiment 3, the rigidity against the shrink-fitting force is further increased, minimizing deformation, and it is possible to obtain the same advantages as those obtained in Embodiment 1.

Embodiment 4

Figure 6:
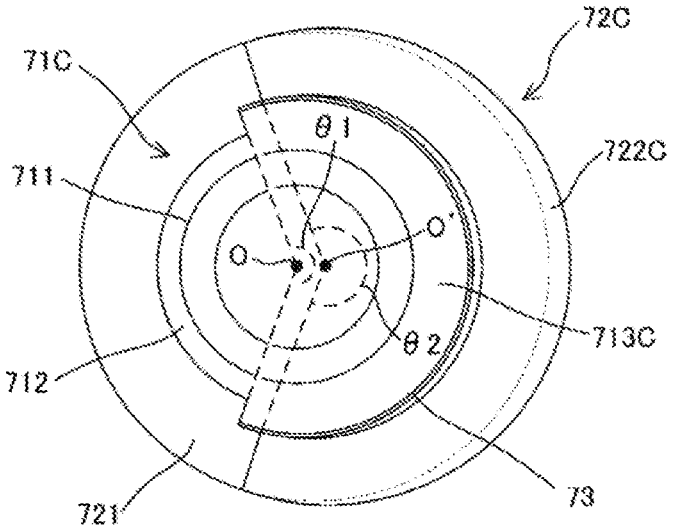
FIG. 6 shows a bushing of a scroll compressor according to Embodiment 4 of the present invention, as viewed from one end.
Figure 7:
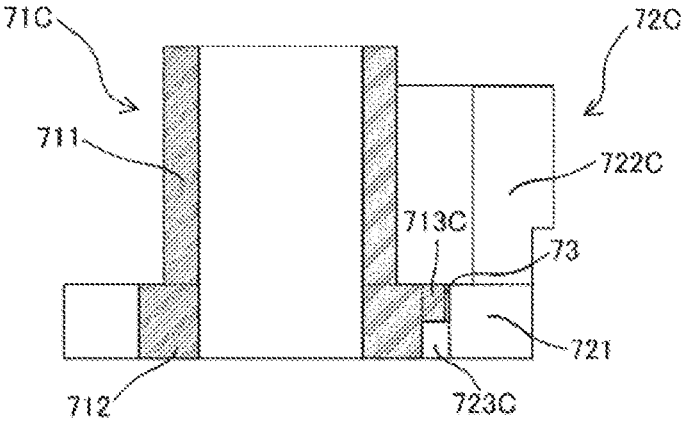
FIG. 7 is a sectional view showing the structure of the bushing of the scroll compressor according to Embodiment 4 of the present invention.

FIG. 6 shows the structure of a bushing of a scroll compressor according to Embodiment 4 of the present invention, and FIG. 7 is a sectional view showing the structure of the bushing of the scroll compressor according to Embodiment 4 of the present invention.

As shown in FIGS. 6 and 7, in Embodiment 4, a flange portion 713C of a slider 71C is formed on a portion of the outer circumferential surface of the second tubular portion 712, and a projection 723C of a balance weight 72C is formed on a portion of the inner circumferential surface of the ring-like portion 721. Furthermore, the area in which the flange portion 713C and the projection 723C are formed is formed in association with the portion in which a weight portion 722C is formed.

More specifically, the weight portion 722C has a C shape in which θ1, which is the angle that satisfies $\theta 1<360°$, where θ1 is an angle defined by the center O' of the arc of the weight portion 722C, and both ends of the weight portion 722C. The flange portion 713C has a C shape in which θ2, which is the angle that satisfies $\theta 1 \leq \theta 2<360°$ where θ2 is an angle defined by the center O' of the arc of the flange portion 713C and the both end portions of the flange portion 713C. The weight portion 722C is disposed such that the angle θ1 is included in the angle θ2 of the flange portion 713C, that is, such that the C-shaped portion of the flange portion 713C and the C-shaped portion of the weight portion 722C face each other. For example, the angle θ1 is 220°, and the angle θ2 is 240°. It is more preferable that the angle θ1 and the angle θ2 be between 180° and 270°. In Embodiment 4, because the area in which the flange portion 713C is formed corresponds to the weight portion 722C, which is formed in the area where the centrifugal force of the orbiting scroll 32 can be cancelled out, it is possible to receive the moment applied to the weight portion 722C with contact surfaces and to increase the shrink fitting area in a portion where the flange portion 713C is not formed.

Note that the present invention is not limited to the invention according to the above-described embodiments and can be appropriately modified within the scope not departing from the spirit thereof. For example, although vertical scroll compressors have been described in the above-described embodiments, the present invention can also be applied to horizontal scroll compressors. Furthermore, low-pressure shell scroll compressors have been described in the above-described embodiments, the present invention can also be applied to high-pressure shell scroll compressors.

REFERENCE SIGNS LIST

1 shell 11 middle shell 111 suction pipe 12 lower shell 121 fixing base 13 upper shell 131 discharge pipe 2 main frame 21 body unit 211 accommodating space 212 thrust surface 22 main bearing unit 221 through-hole 3 compression mechanism unit 31 fixed scroll 311 first substrate 312 first spiral body 32 orbiting scroll 321 second substrate 322 second spiral body 323 tubular portion 33 Oldham ring 34 compression space 35 discharge valve 36 muffler 361 discharge hole 4 driving mechanism unit stator 42 rotor 5 sub frame 51 auxiliary bearing unit 52 oil pump 6 crank shaft 61 main shaft unit 62 eccentric shaft unit 63 lubricant passage hole 7 bushing 71 slider 711 first tubular portion 712 second tubular portion 713 flange portion 72 balance weight 721 ring-like portion 722 weight portion 723 projection 73 gap 8 power supply unit 81 cover 82 power supply terminal 83 wire U one end L the other end

The invention claimed is:

1. A scroll compressor comprising:

a compression mechanism unit including a fixed scroll and an orbiting scroll;

a crank shaft configured to cause the orbiting scroll to orbit about the fixed scroll;

a slider provided between the orbiting scroll and the crank shaft and including a tubular portion having an outer circumferential surface and a flange portion projecting from the outer circumferential surface of the tubular portion between a first tubular end and a second tubular end of the tubular portion; and a balance weight fitted to the slider and including a ring-like portion having an inner surface facing an outer circumferential surface of the flange portion, a weight portion having an inner surface facing the outer circumferential surface of the tubular portion between the first tubular end and the flange portion, and a projection projecting from an inner circumferential surface of the ring-like portion and having an inner surface facing the outer circumferential surface of the tubular portion between the second tubular end and the flange portion, and the inner surface of the projection extending to the second tubular end.

2. The scroll compressor of claim 1, wherein a surface of the flange portion facing towards a side of the slider having the second tubular end and a surface of the projection facing towards a side of the slider having the first tubular end are in contact with each other.

3. The scroll compressor of claim 1, wherein the outer surface of the flange portion and a portion of the inner surface of the ring-like portion are fitted together.

4. The scroll compressor of claim 1, wherein the slider and the balance weight are shrink-fitted together.

5. The scroll compressor of claim 1, wherein the tubular portion of the slider includes a first tubular portion and a second tubular portion, the first tubular portion including the first tubular end and the second tubular portion including the second tubular end, and the flange portion is formed on the second tubular portion.

6. The scroll compressor of claim 5, wherein a thickness T2 of the second tubular portion is larger than a thickness T1 of the first tubular portion.

7. The scroll compressor of claim 6, wherein an outside diameter D2 of the second tubular portion is larger than an outside diameter D1 of the first tubular portion.

8. A refrigeration cycle device comprising the scroll compressor of claim 1, wherein refrigerant including HFO1234yf is used.

9. A scroll compressor, comprising:

a compression mechanism unit including a fixed scroll and an orbiting scroll;

a crank shaft configured to cause the orbiting scroll to orbit about the fixed scroll;

a slider provided between the orbiting scroll and the crank shaft and including a tubular portion having an outer circumferential surface and a flange portion projecting from the outer circumferential surface of the tubular portion between a first tubular end and a second tubular end of the tubular portion; and a balance weight fitted to the slider and including a ring-like portion having an inner surface facing an outer circumferential surface of the flange portion, a weight portion having an inner surface facing the outer circumferential surface of the tubular portion between the first tubular end and the flange portion, and a projection projecting from an inner circumferential surface of the ring-like portion and having an inner surface facing the outer circumferential surface of the tubular portion between the second tubular end and the flange portion, wherein the outer surface of the tubular portion between the second tubular end and the flange portion and the inner surface of the projection are fitted together, and a gap is provided between the outer surface of the flange portion and a portion of the inner surface of the ring-like portion.

10. A scroll compressor comprising:

a compression mechanism unit including a fixed scroll and an orbiting scroll;

a crank shaft configured to cause the orbiting scroll to orbit about the fixed scroll;

a slider provided between the orbiting scroll and the crank shaft and including a tubular portion having an outer circumferential surface and a flange portion projecting from the outer circumferential surface of the tubular portion between a first tubular end and a second tubular end of the tubular portion; and a balance weight fitted to the slider and including a ring-like portion having an inner surface facing an outer circumferential surface of the flange portion, a weight portion having an inner surface facing the outer circumferential surface of the tubular portion between the first tubular end and the flange portion, and a projection projecting from an inner circumferential surface of the ring-like portion and having an inner surface facing the outer circumferential surface of the tubular portion between the second tubular end and the flange portion, wherein the inner surface of the projection and an outer surface of the tubular portion between the second tubular end and the flange portion are fitted together in a manner so that the inner surface of the projection engagingly contacts a portion of the outer surface of the tubular portion.

* * * * *